US007387411B1

(12) United States Patent
Tsai

(10) Patent No.: US 7,387,411 B1
(45) **Date of Patent: *Jun. 17, 2008**

(54) ELECTRONIC CANDLE

(75) Inventor: Ching-Tien Tsai, Changhua Hsien (TW)

(73) Assignee: Hsinn Inn Enterprise Co., Ltd., Changhua Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/684,377

(22) Filed: Mar. 9, 2007

(51) Int. Cl.
*F21V 35/00* (2006.01)

(52) U.S. Cl. ..... 362/392; 362/810

(58) Field of Classification Search ..... 362/191, 362/190, 392, 810
See application file for complete search history.

(56) References Cited

U.S. PATENT DOCUMENTS 6,017,139 A * 1/2000 Lederer ..... 362/394
7,011,426 B2 * 3/2006 Gabor ..... 362/161
7,178,939 B2 * 2/2007 Tsai ..... 362/190
2005/0169666 A1 * 8/2005 Porchia et al. ..... 399/111
2005/0169812 A1 * 8/2005 Helf et al. ..... 422/123
2006/0238136 A1 * 10/2006 Johnson, III et al. ... 315/185 R
2007/0159422 A1 * 7/2007 Blandino et al. ..... 345/82
2007/0223217 A1 * 9/2007 Hsu ..... 362/183

* cited by examiner

*Primary Examiner*—Hargobind S Sawhney
(74) *Attorney, Agent, or Firm*—Alan Kamrath; Kamrath & Associates PA

(57) ABSTRACT

An electronic candle comprises a candle housing including a plurality of insertions secured in the interior thereof, a bulb protective cap fixed on the top surface of the candle housing, a circuit board engageably fitted into the interior of the candle housing and including a LED arranged on the top surface thereof, a power switch, an electrically conductive ring and an electrically conductive compression spring all in turn secured on the bottom surface thereof, and by way of a chamber surrounded by the ring and the insertions, a cell may be received therein, a bottom lip covered at the bottom of the candle housing, thereby assembling related components easily and lowering production costs.

6 Claims, 8 Drawing Sheets

ELECTRONIC CANDLE

BACKGROUND OF THE INVENTION

1. Field of the Invention

The present invention relates to an electronic candle, and more particularly to an electronic candle that may be operated safely so as to replace the traditional candle, and to lower related components and production costs thereof.

2. Description of the Prior Arts

A prior art candled is employed for a decoration, a celebration or a religious ceremony, etc. However, a fire may occur in practical use due to carelessness, hence a variety of electronic candles have been developed in recent days.

U.S. Pat. No. 7,178,939 issued on Feb. 20, 2007, to Ching-Tien Tsai discloses an electronic simulation candle including a housing, a lamp shade, a battery box, a circuit board, and a bottom cover.

The housing has a candle shape and has a top face formed with a through hole, an inside provided with a plurality of threaded studs and an opened bottom having an inner wall formed with an annular groove and a periphery formed with a positioning depression.

The lamp shade has a candle flame shape. The lamp shade is secured on the top face of the housing by bonding and has a lower end formed with a reduced mounting portion inserted into the through hole of the housing.

The battery box is mounted in the housing and includes a circular plate having a mediate portion formed with a hollow portion and a periphery formed with a plurality of fixing holes secured to the threaded studs of the housing by screws, an annular frame mounted on a bottom face of the plate, two spaced fixing pieces mounted on the bottom face of the plate, and a plurality of threaded posts mounted on the periphery of the plate. The frame has a periphery formed with a positioning lug.

The circuit board is fixed on the battery box by bonding and located in the housing. The circuit board has a first side provided with two light emitting members and mounted in the lamp shade and a second side provided with a power switch extended through the hollow portion of the battery box and located between the fixing pieces of the battery box, a conducting spring extended through the hollow portion of the battery box into the frame of the battery box, and a conducting elastic plate extended through the hollow portion of the battery box into the frame of the battery box. The two light emitting members and are located at different height levels and connected to the circuit board by two conducting wires. The power switch is controlled in a manual, vibration or optical sensitive manner.

A battery is mounted in the frame of the battery box and rested on the conducting spring and the conducting elastic plate.

The bottom cover is mounted in the annular groove of the housing and rested on the battery. The bottom cover has a plurality of locking holes secured to the threaded posts of the battery box by screws. The bottom cover has a side formed with a conical through hole, and the power switch has a drive lever extended through the through hole of the bottom cover. The bottom cover has a periphery formed with a positioning protrusion positioned in the positioning depression of the housing and a positioning opening to position the positioning lug of the battery box.

Nevertheless, such an electronic simulation candle has more related components, thus causing a complicated assembly and higher production costs.

The present invention has arisen to mitigate and/or obviate the afore-described disadvantages.

SUMMARY OF THE INVENTION

The primary objective of the present invention is to provide an electronic candle, which has less related components for lowering the production costs, and for assembling easily.

Another objective of the present invention is to provide an electronic candle, the bottom lid of which is straightly covered onto the bottom of the candle housing, thereby replacing the cell easily.

The electronic candle comprises a candle housing, a bulb protective cap, a circuit board and a bottom lid, wherein the candle housing is constructed in the form of a short hollow cylinder, and includes a retaining hole formed at the center of the top surface thereof, includes an inverted U-shaped mounting frame disposed in the interior thereof and having a positioning slot arranged about the inner wall thereof, includes a plurality of insertions secured in the interior thereof, and includes a plurality of hollow locking pillars attached to the inner wall thereof. Furthermore, on the inner periphery at the bottom of the candle housing is fixed an annular groove and on one side at the bottom thereof is mounted a recess. The bulb protective cap is formed in the shape of a flame, and contains an engaging segment with a small-diameter affixed at the lower end thereof. The shape of the circuit board is formed in response to that of the positioning slot, and the circuit board is comprised of a LED arranged on the top surface thereof, and includes a power switch, a T-shaped electrically conductive ring as well as an electrically conductive compression spring all in turn secured on the bottom surface thereof. The power switch contains a movable latch extended from the interior thereof, and may be controlled in a manual, vibration or optical sensitive manner. The bottom lip comprises a through bore formed in one side thereof, a fastening tab extendedly attached on the rim thereof, three upright prongs and two support pegs all extended from the top surface thereof.

In assembly, the bulb protective cap is adhesively inserted into the retaining hole of the candle housing by means of the engaging segment so as to be fixed on the top surface of the candle housing. The circuit board is engageably fitted onto the positioning slot of the candle housing so that the LED thereof may be correspondingly inserted into the bulb protective cap, and by way of a chamber surrounded by the ring and the insertions, the cell is received in the chamber. Further, the bottom lip is engageably covered in the annular groove at the bottom of the candle housing, such that the fastening tab of the bottom lip may engage with the recess of the candle housing. The upright prongs of the bottom lip are engageably inserted into the hollow locking pillars of the candle housing, and the support pegs are utilized to supportably retained the cell such that the cell allows to stably contact with the ring and the spring, and the movable latch of the power switch extends out of the through bore of the bottom lip.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
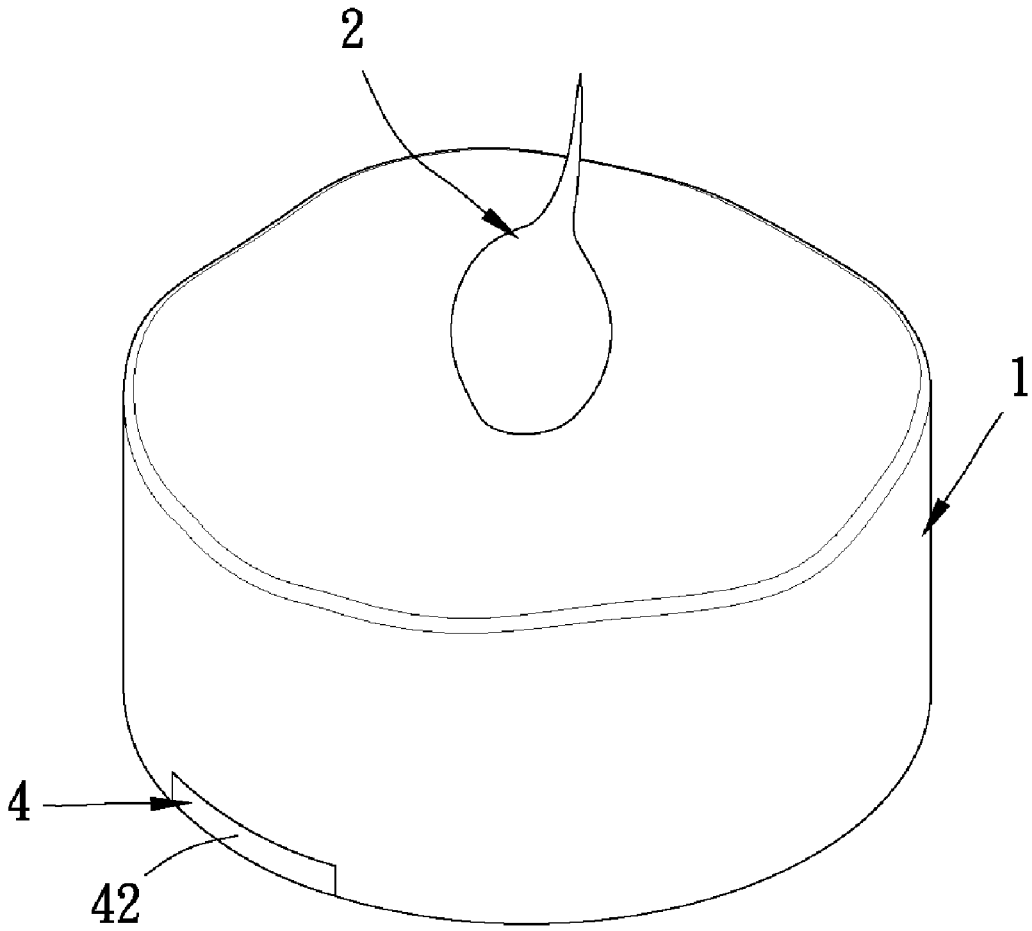
FIG. 1 is a perspective view of an electronic candle in accordance with the present invention.
Figure 2:
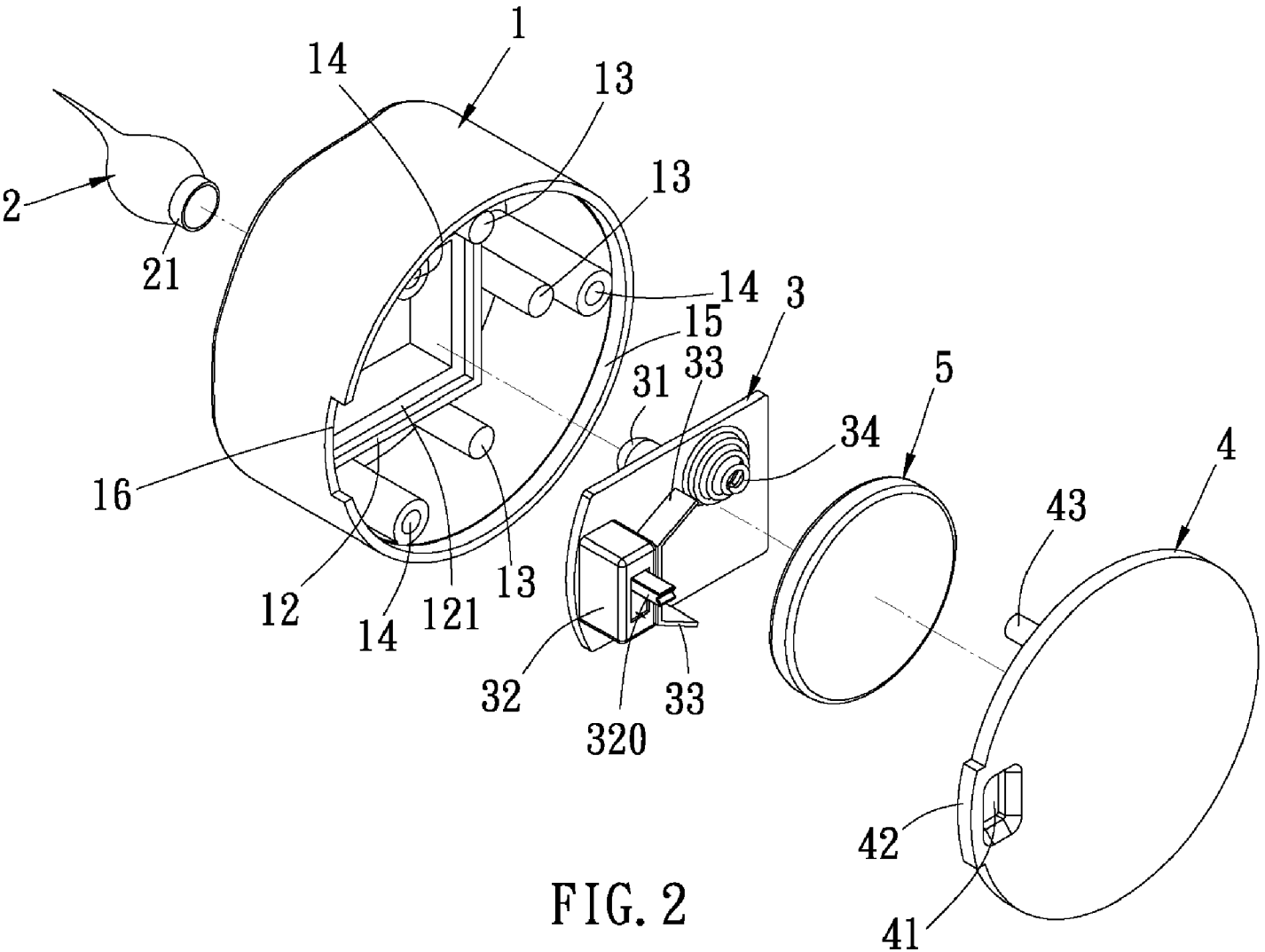
FIG. 2 is an exploded view of the electronic candle in accordance with the present invention.
Figure 3:
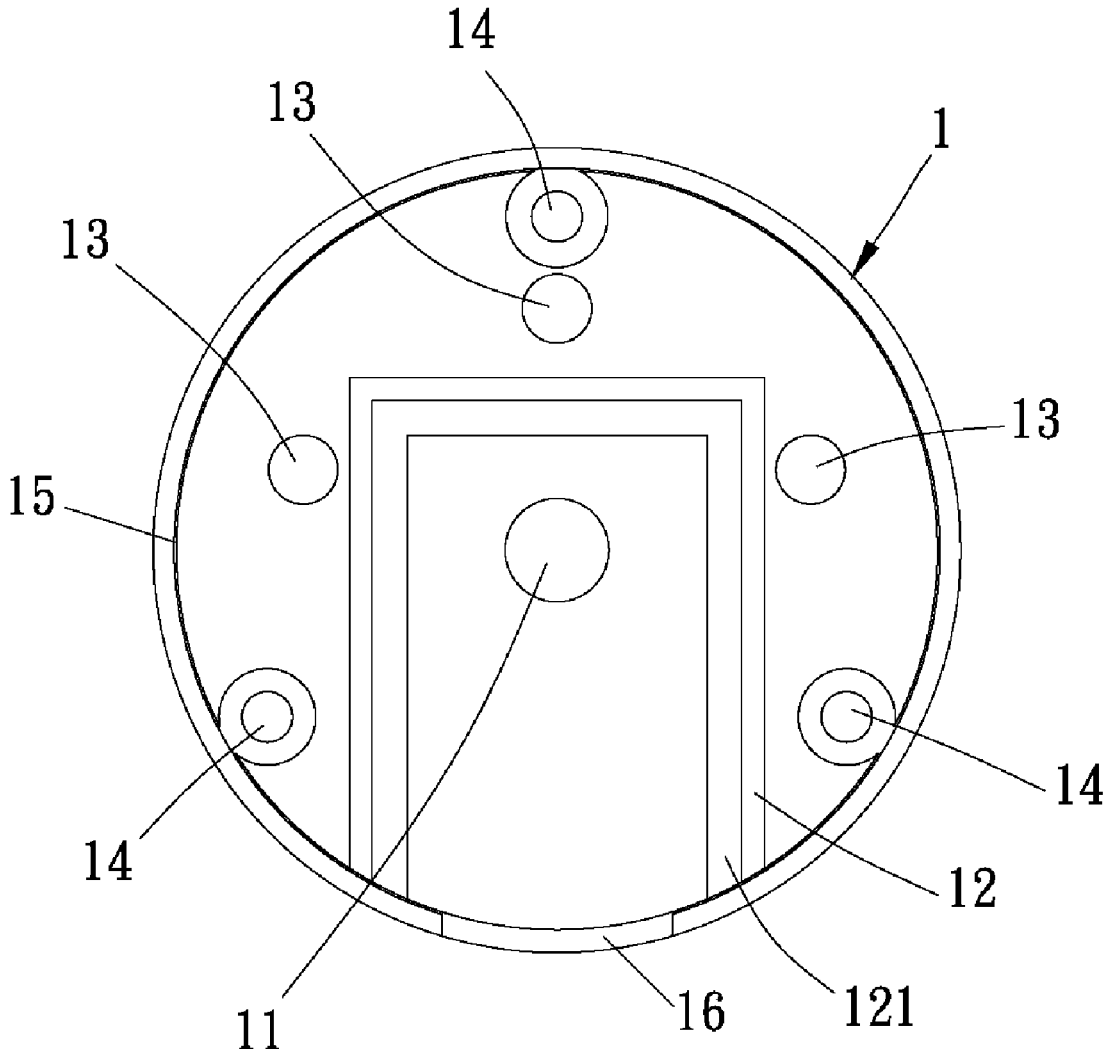
FIG. 3 is a top plan view of the candle housing of the present invention.
Figure 4:
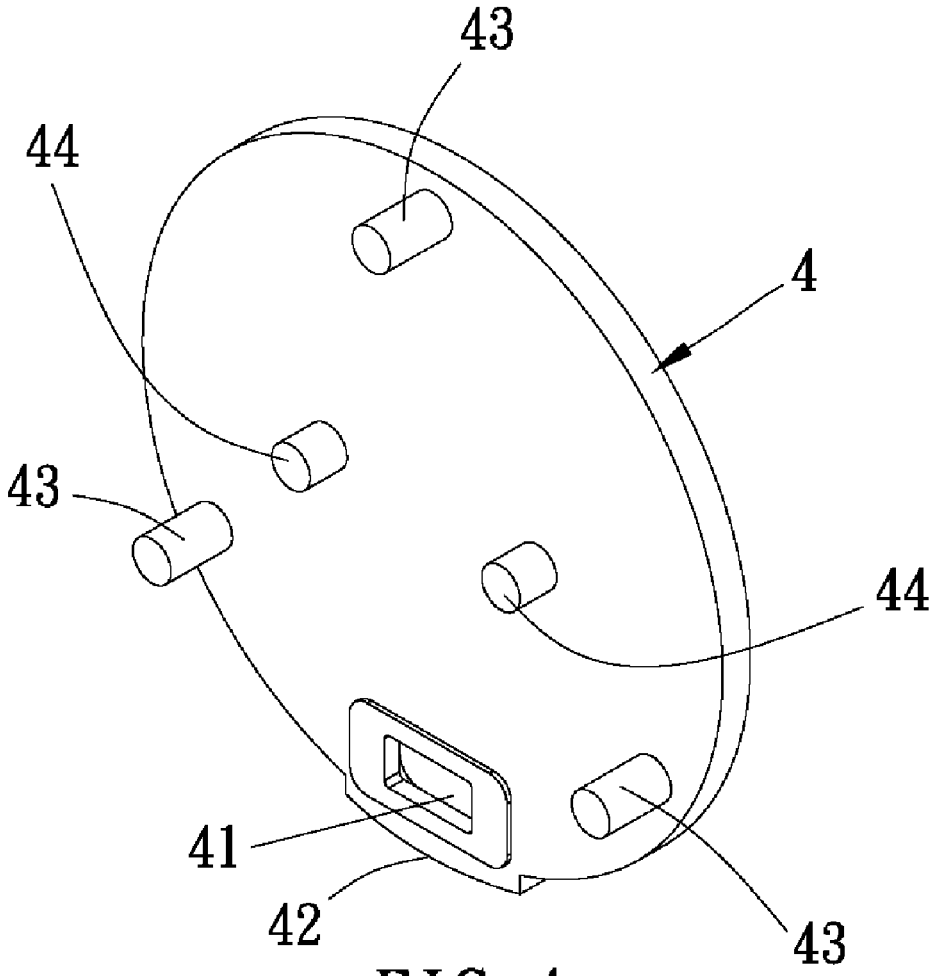
FIG. 4 is a perspective view of the bottom lip of the present invention.
Figure 5:
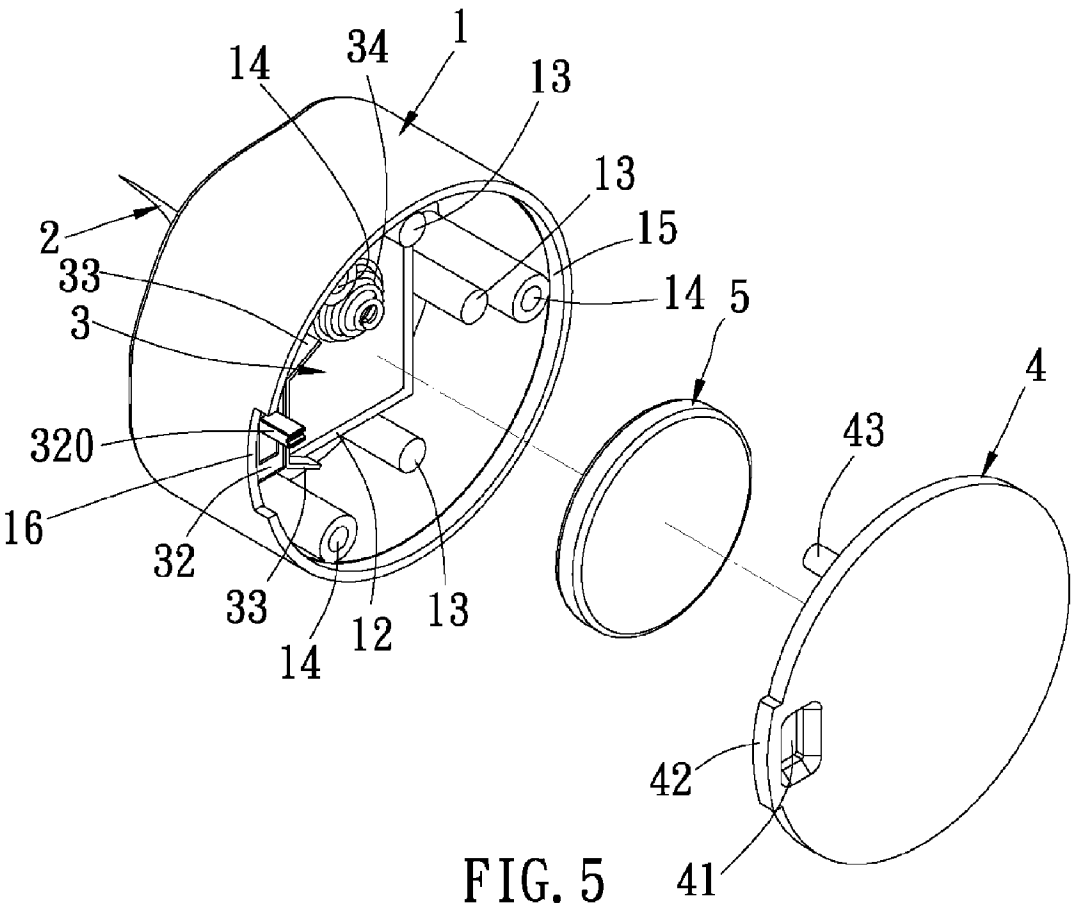
FIG. 5 is an assembly view illustrating the bulb protective cap and the circuit board have been assembled into the candle housing.
Figure 6:
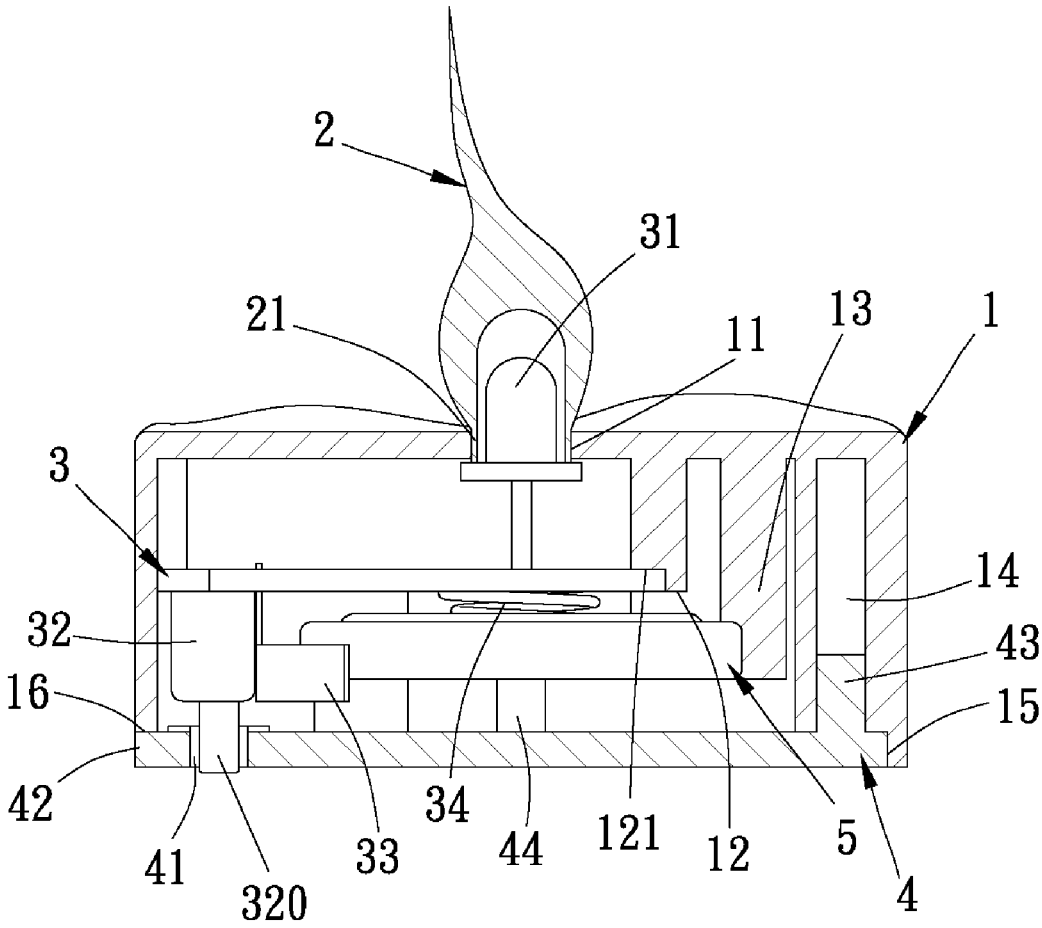
FIG. 6 is a cross sectional assembly view of the electronic candle in accordance with the present invention.

Referring to FIGS. 1-6, an electronic candle in accordance with the present invention comprises a candle housing 1, a bulb protective cap 2, a circuit board 3 and a bottom lid 4, wherein the candle housing 1 is constructed in the form of a short hollow cylinder, and includes a retaining hole 11 formed at the center of the top surface thereof, includes an inverted U-shaped mounting frame 12 disposed in the interior thereof and having a positioning slot 121 arranged about the inner wall thereof, includes three insertions 13 secured in the interior thereof, and includes three hollow locking pillars 14 attached to the inner wall thereof. Furthermore, on the inner periphery at the bottom of the candle housing 1 is fixed an annular groove 15 and on one side at the bottom thereof is mounted a recess 16. The bulb protective cap 2 is formed in the shape of a flame, and contains an engaging segment 21 with a small-diameter affixed at the lower end thereof. The shape of the circuit board 3 is formed in response to that of the positioning slot 121, and the circuit board 3 is comprised of a LED 31 arranged on the top surface thereof, and includes a power switch 32, a T-shaped electrically conductive ring 33 as well as an electrically conductive compression spring 34 all in turn secured on the bottom surface thereof. The power switch 32 contains a movable latch 320 extended from the interior thereof, and may be controlled in a manual, vibration or optical sensitive manner. The bottom lip 4 comprises a through bore 41 formed in one side thereof, a fastening tab 42 extendedly attached on the rim thereof, three upright prongs 43 and two support pegs 44 all extended from the top surface thereof.

In assembly, the bulb protective cap 2 is adhesively inserted into the retaining hole 11 of the candle housing 1 by means of the engaging segment 21 so as to be fixed on the top surface of the candle housing 1. The circuit board 3 is engageably fitted onto the positioning slot 121 of the candle housing 1 so that the LED 3 thereof is correspondingly inserted into the bulb protective cap 2, and by way of a chamber surrounded by the ring 33 and the insertions 13, the cell 5 is received in the chamber. Further, the bottom lip 4 is engageably covered in the annular groove 15 at the bottom of the candle housing 1, such that the fastening tab 42 of the bottom lip 4 may engage with the recess 16 of the candle housing 1. The upright prongs 43 of the bottom lip 4 are engageably inserted into the hollow locking pillars 14 of the candle housing 1, and the support pegs 44 are utilized to supportably retained the cell 5 such that the cell 5 allows to stably contact with the ring 33 and the spring 34, and the movable latch 320 of the power switch 32 extends out of the through bore 41 of the bottom lip 4.

Figure 7:
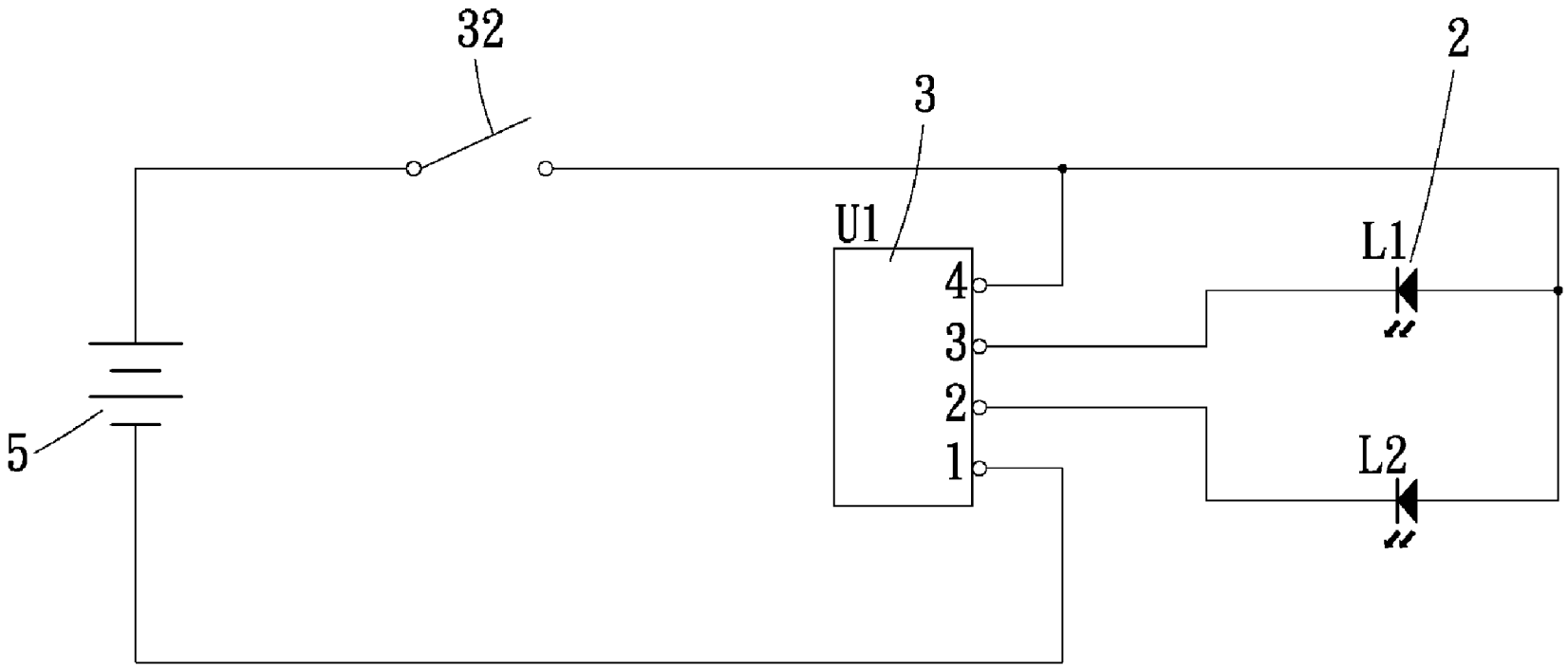
FIG. 7 is a circuit diagram of the electronic candle as shown in FIG. 1
Figure 8:
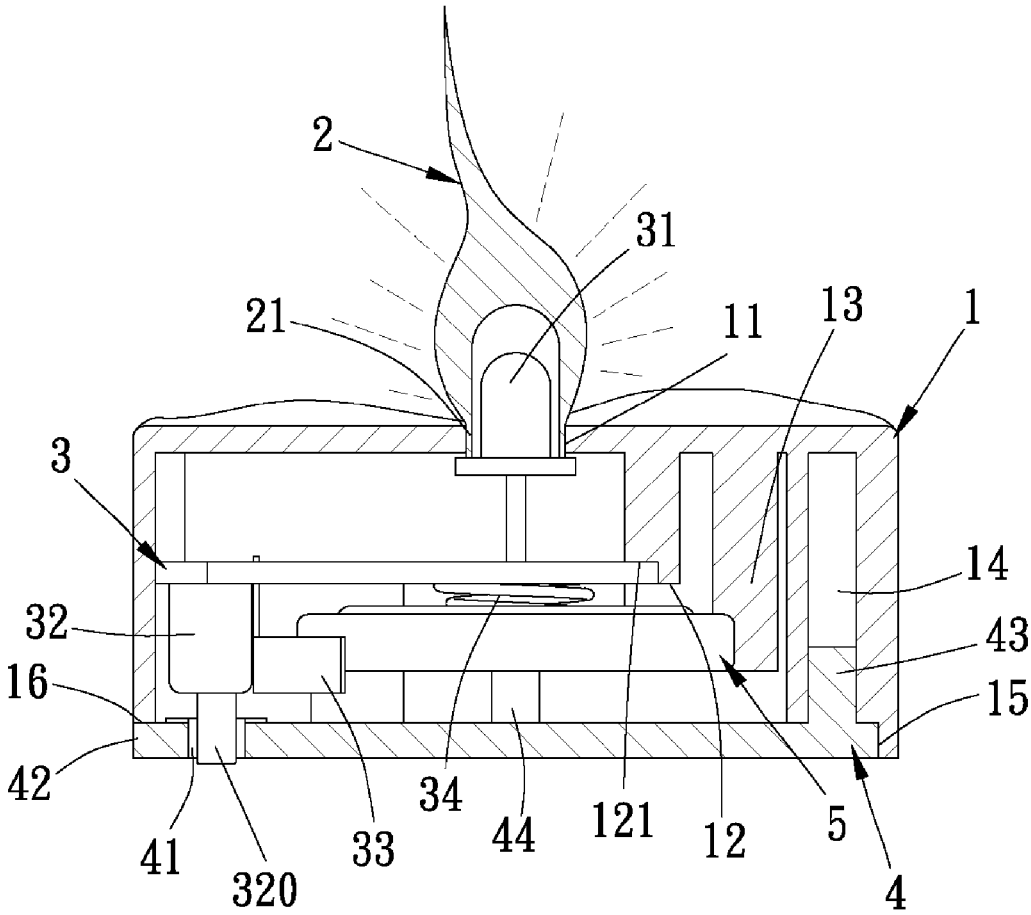
FIG. 8 is a cross sectional assembly view, illustrating the application of the present invention.

In operation, as shown in FIGS. 7 and 8, the movable latch 320 of the power switch 32 is turned on so as to conduct electricity between the cell 5 and the circuit board 3, such that the circuit board 3 may control the LED 31 to emit light like a candle.

It is to be noted that the bottom lip 4 may be adhesively covered in the annular groove 15 at the bottom of the candle housing 1 with glue.

It can be clearly seen from the preceding accounts on the features of the present invention that the electronic candle of the present invention has the following advantages:

First, the present invention is formed of the candle housing 1, the bulb protective cap 2, the circuit board 3 as well as the bottom lid 4, and may emit light like the candle by cooperating with the cell 5, thus having less related components for lowering the production costs, and for assembling easily.

Second, the bottom lid 4 is straightly covered onto the bottom of the candle housing 1, and the upright prongs 43 of the bottom lip 4 are engageably inserted into the hollow locking pillars 14 of the candle housing 1, thereby securely combining related components together and replacing the cell 5 easily.

The invention is not limited to the above embodiment but various modifications thereof may be made. It will be understood by those skilled in the art that various changes in form and detail may made without departing from the scope and spirit of the present invention.

What is claimed is:

1. An electronic candle comprising:

a candle housing including a plurality of insertions secured in the interior thereof, a bulb protective cap fixed on the top surface of said candle housing;

a circuit board engageably fitted into the interior of said candle housing, and including a LED arranged on the top surface thereof, a power switch, an electrically conductive ring and an electrically conductive compression spring all in turn secured on the bottom surface thereof, and by way of a chamber surrounded by said ring and said insertions, a cell may be received therein;

a bottom lip covered at the bottom of said candle housing.

2. The electronic candle as claimed in claim 1, wherein said candle housing includes a mounting frame disposed in the interior thereof and having a positioning slot arranged about the inner wall thereof, for engageably receiving said circuit board.

3. The electronic candle as claimed in claim 2, wherein said mounting frame is formed in the shape of an inverted U.

4. The electronic candle as claimed in claim 1, wherein said candle housing includes a plurality of hollow locking pillars attached to the inner wall thereof, and said bottom lip includes a plurality of upright prongs extended from the top surface thereof and corresponding to said hollow locking pillars.

5. The electronic candle as claimed in claim 1, wherein said electrically conductive ring is formed in the shape of a "T".

6. The electronic candle as claimed in claim 1, wherein said bottom lid contains a plurality of support pegs extended from the top surface thereof, for supportably retaining said cell.

* * * * *